US011480322B1

(12) United States Patent
Chen

(10) Patent No.: US 11,480,322 B1
(45) Date of Patent: Oct. 25, 2022

(54) MAGNETIC SIGNAGE LIGHTING SYSTEM

(71) Applicant: Sikai Chen, Delran, NJ (US)

(72) Inventor: Sikai Chen, Delran, NJ (US)

( * ) Notice: Subject to any disclaimer, the term of this patent is extended or adjusted under 35 U.S.C. 154(b) by 0 days.

(21) Appl. No.: 17/548,667

(22) Filed: Dec. 13, 2021

(51) Int. Cl.

| | |
|---|---|
| ***F21V 21/096*** | (2006.01) |
| ***F21V 23/06*** | (2006.01) |
| ***H01R 33/74*** | (2006.01) |
| ***G09F 13/00*** | (2006.01) |
| ***G09F 13/04*** | (2006.01) |
| ***H01R 13/62*** | (2006.01) |
| ***F21Y 115/10*** | (2016.01) |

(52) U.S. Cl.
CPC ..... *F21V 21/096* (2013.01); *F21V 23/06* (2013.01); *G09F 13/005* (2013.01); *G09F 13/0404* (2013.01); *H01R 13/6205* (2013.01); *H01R 33/74* (2013.01); *F21Y 2115/10* (2016.08)

(58) Field of Classification Search
CPC ..... F21V 21/096; F21V 23/06; G09F 13/005; G09F 13/0404; H01R 13/6205; H01R 33/74; F21Y 2115/10
See application file for complete search history.

(56) References Cited

U.S. PATENT DOCUMENTS 4,532,579 A * 7/1985 Merryman ..... G09F 13/0404 362/310
7,165,863 B1 * 1/2007 Thomas ..... H05K 3/28 362/373
8,894,419 B1 * 11/2014 Buelow ..... H02J 7/0045 439/39
8,915,609 B1 * 12/2014 Shah ..... H05B 45/30 362/648
9,300,083 B2 * 3/2016 Bosscher ..... H01R 13/6683
10,832,600 B2 * 11/2020 Deng ..... H01R 13/6205
10,938,170 B1 * 3/2021 Chen ..... H01R 25/003
11,054,125 B1 * 7/2021 Chen ..... F21V 23/06
2003/0112627 A1 * 6/2003 Deese ..... F21V 21/0832 362/800
2006/0134978 A1 * 6/2006 Rosen ..... H01R 13/514 439/581
2013/0255116 A1 * 10/2013 Kaoh ..... G02B 6/0091 40/563
2015/0102731 A1 * 4/2015 Altamura ..... A47G 33/0836 315/152
2017/0162087 A1 * 6/2017 Schmidt ..... G09F 13/0404
2020/0273383 A1 * 8/2020 Deng ..... G09F 13/22
2020/0302836 A1 * 9/2020 Tan ..... G09F 13/22

* cited by examiner

*Primary Examiner* — Tsion Tumebo
(74) *Attorney, Agent, or Firm* — Stuart M. Goldstein

(57) ABSTRACT

Magnet signage lighting systems are disclosed in which electricity and informational data are transferred from wiring extending from an electrical power source to one or more electrical connector members. At least one power source magnet is electrically connected to the connector member or members. Signage lighting members have lighting member magnets affixed thereto such that when the lighting member magnet is attracted to and connected to the power source magnet, electricity and informational data is transmitted from the power source and an informational data controller, through the connector member or members, to the power source magnet, and then to the lighting member magnet to illuminate and provide informational data to the signage lighting members.

11 Claims, 9 Drawing Sheets

MAGNETIC SIGNAGE LIGHTING SYSTEM

FIELD OF THE INVENTION

This invention relates to illuminated signage and, in particular, to the connection of electrical signage to electrical circuitry.

BACKGROUND OF THE INVENTION

Electrical signage, whether illuminated by LEDs, neon, bulbs, or other light sources, is commonly found in a myriad of locations, including, but certainly not limited to outdoor advertising, restaurants, retail storefronts, commercial buildings, hotels, and amusement parks. The signage utilized in these locations usually comprises extensive wiring, fittings, electrical connectors, power sources and other electrical components to transmit electricity to the (LED, neon, etc.) signage. The electrical connections between the circuitry and the signage itself are required in order to ensure proper and retentive illumination. As a result, installation of these electrical signage systems is labor intensive. In addition, given the number of electrical components and accessories which are required, long term reliability becomes a problem. Replacement of failed components or the substitution of alternate signage also involves excessive labor, time, and cost. There is currently no signage lighting system which is not only easy to install and effective in providing signage illumination, but also addresses the problems associated with known electrical signage systems.

SUMMARY OF THE INVENTION

It is thus the object of the present invention to provide magnetic signage lighting systems which overcome the disadvantages and limitations of existing signage lighting systems.

These and other objects are accomplished by the present invention, magnetic signage lighting systems in which electricity and informational data are transferred from wiring extending from an electrical power source to one or more electrical connector members. At least one power source magnet is electrically connected to the connector member or members. Signage lighting members have lighting member magnets affixed thereto such that when the lighting member magnet is attracted to and connected to the power source magnet, electricity and informational data is transmitted from the power source and an informational data controller, through the connector member or members, to the power source magnet and then to the lighting member magnet to illuminate and provide informational data to the signage lighting members.

The novel features which are considered as characteristic of the invention are set forth in particular in the appended claims. The invention, itself, however, both as to its design, construction and use, together with additional features and advantages thereof, are best understood upon review of the following detailed description with reference to the accompanying drawings.

DETAILED DESCRIPTION OF THE INVENTION

Figure 1:
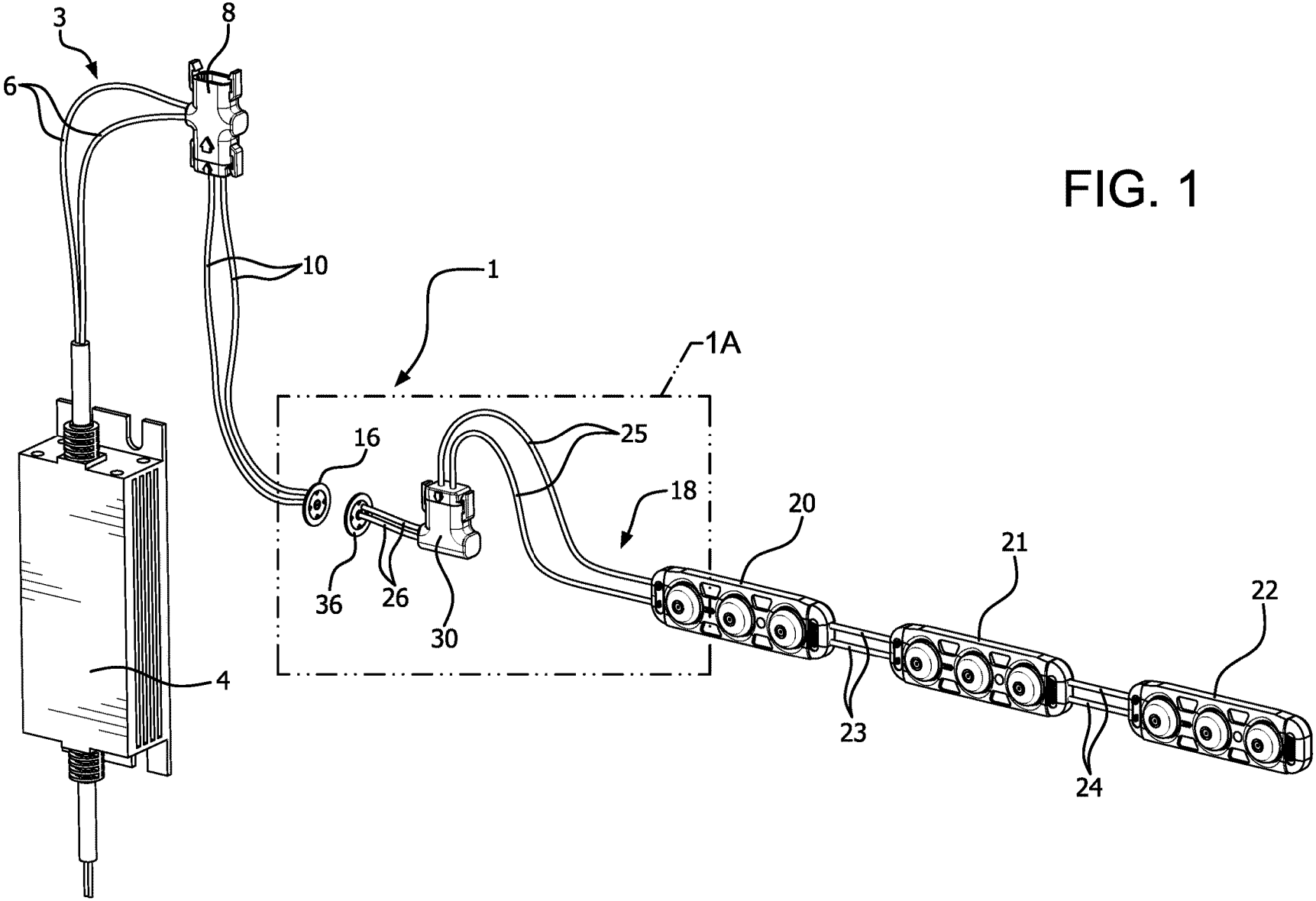
FIG. 1 shows the magnetic lighting system of the present invention.
Figure 1A:
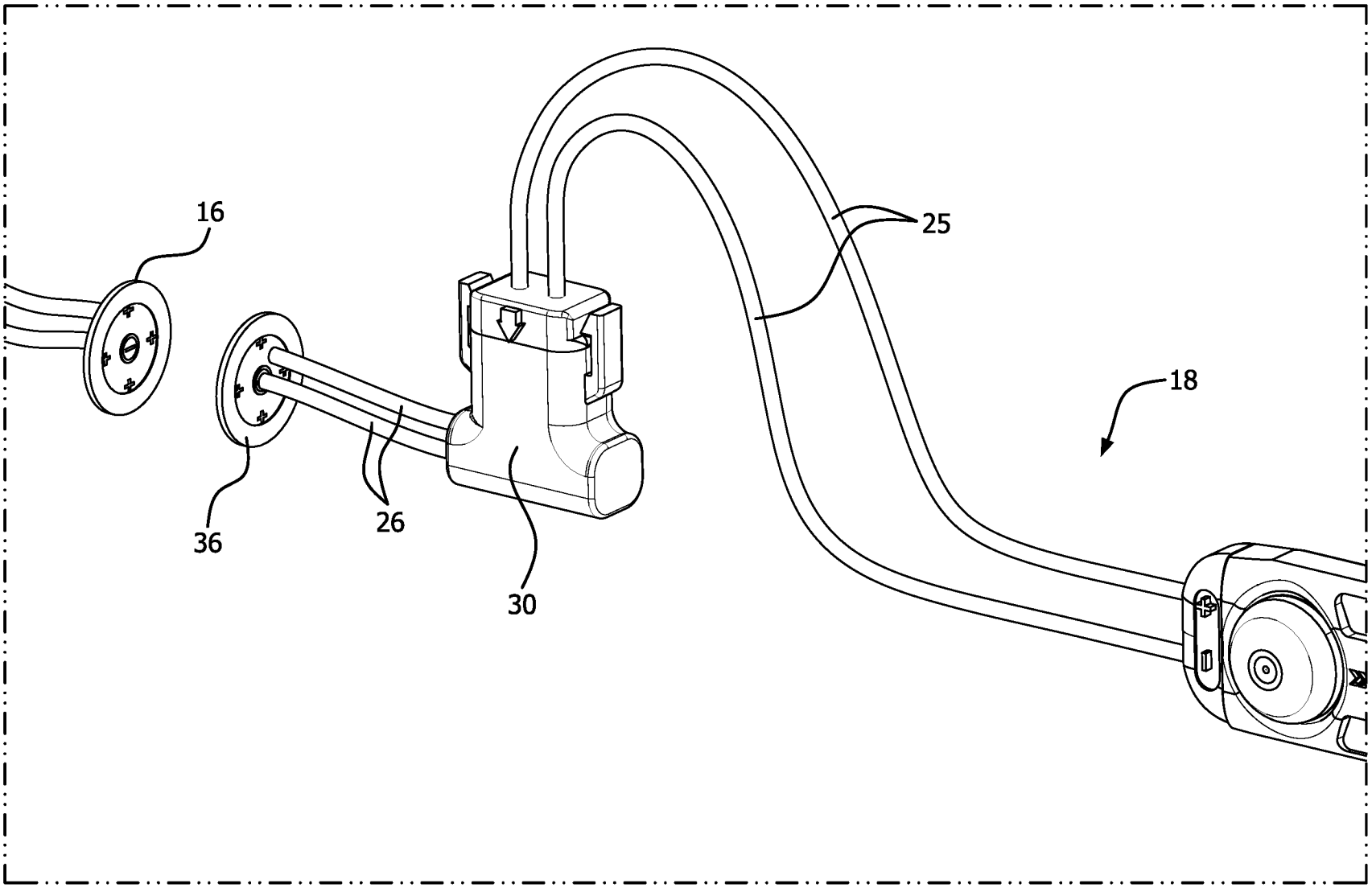
FIG. 1A is a detailed view taken from FIG. 1.

The magnetic lighting system 1 of the present invention, as illustrated in FIG. 1, comprises power source circuitry 3, which itself comprises electrical power source 4 which transmits electricity for the electrical circuitry, wiring 6 extending from the power source to electrical connector member 8, wiring 10 from the connector member to power source magnet 16. The result is that this electrical circuitry 3 transmits electricity from power source 4 through to power source magnet 16. Electrical circuitry 3 is often contained within an electrical raceway, which may be secured to a wall or like mounting surface.

Lighting member circuitry 18 comprises signage lighting members in the form of a series of LED modules 20, 21, and 22, used for signage or other purposes, connected by electrical wiring 23 and 24, and by wiring 25 to electrical connector 30. Connector 30, in turn, is connected by electrical wiring 26 to lighting member magnet 36.

Figure 2:
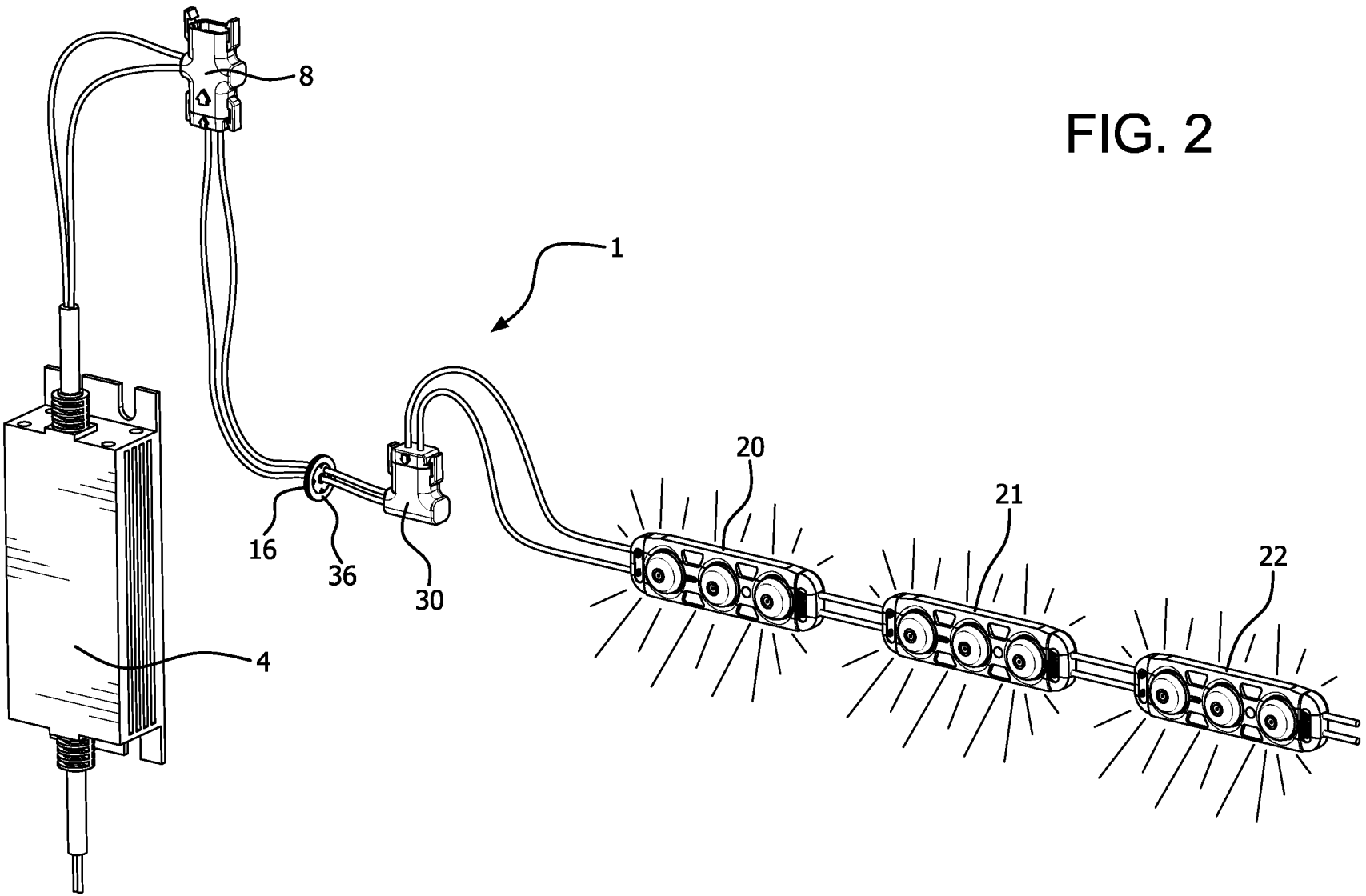
FIG. 2 shows the magnetic lighting system of the present invention with its magnets connected.

In order to illuminate lighting members 20, 21, and 22, lighting member circuitry 18 is positioned so that its lighting member magnet 36 is aligned with and attached to power source magnet 16. This results in electricity from power source 4 being transmitted to and illuminating lighting members 20, 21, and 22, via the attraction and connection of magnets 16 and 36, as illustrated in FIG. 2.

Figure 3:
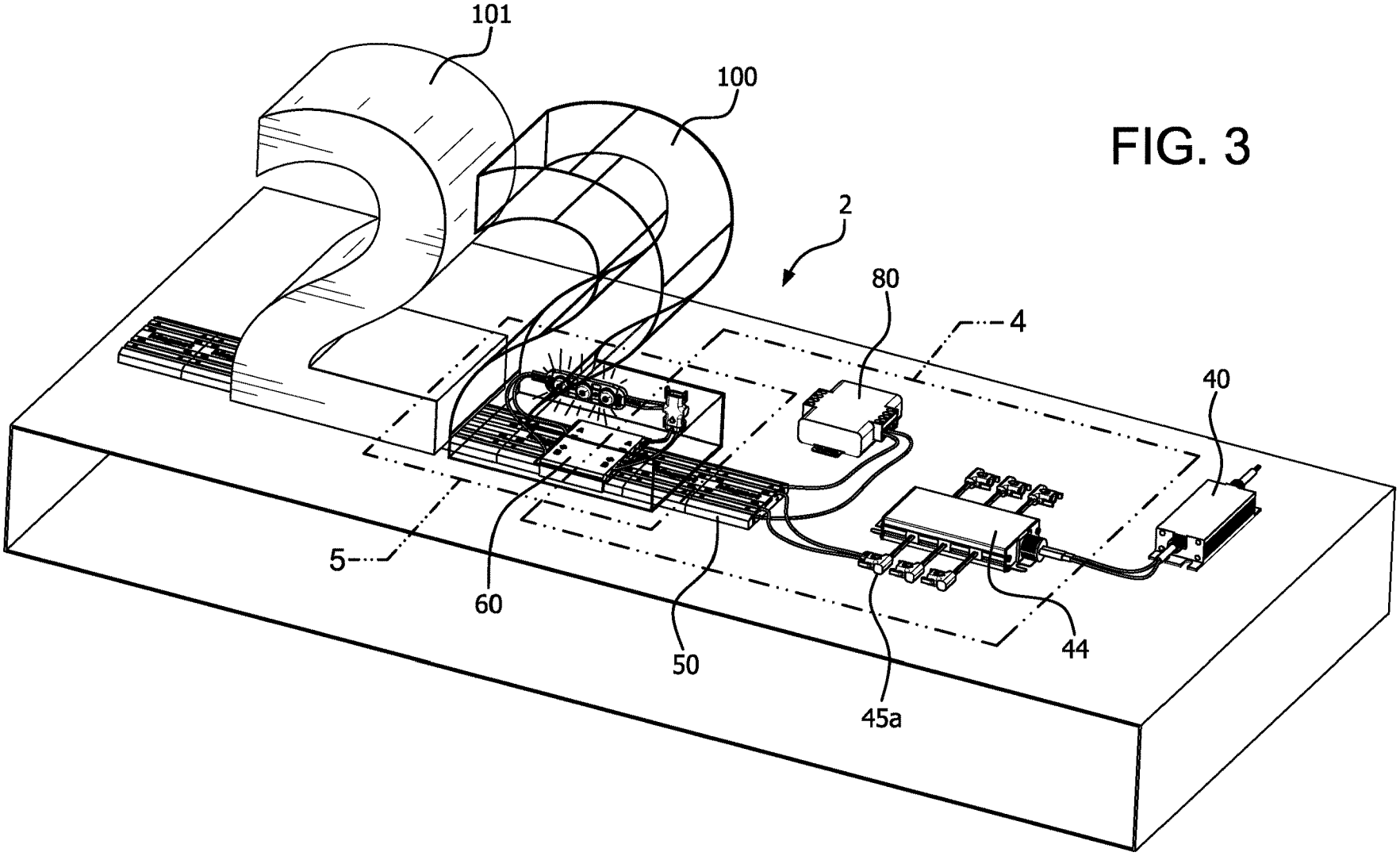
FIG. 3 is an overview of a second embodiment using the magnetic lighting system of the present invention.
Figure 4:
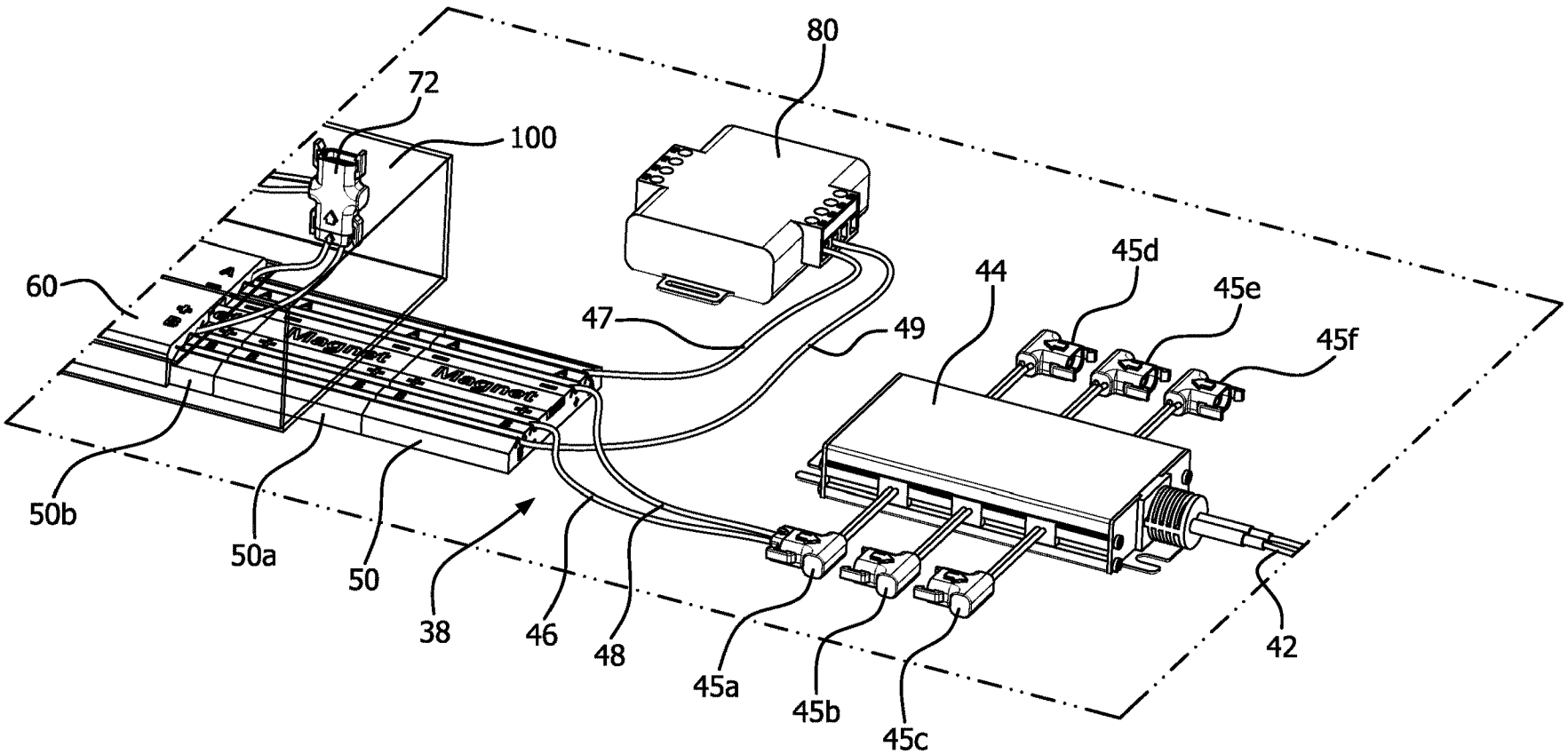
FIG. 4 is a close-up view of the embodiment in FIG. 3 showing the connections from the power source and the informational data controller of the magnetic lighting system of the present invention.
Figure 5:
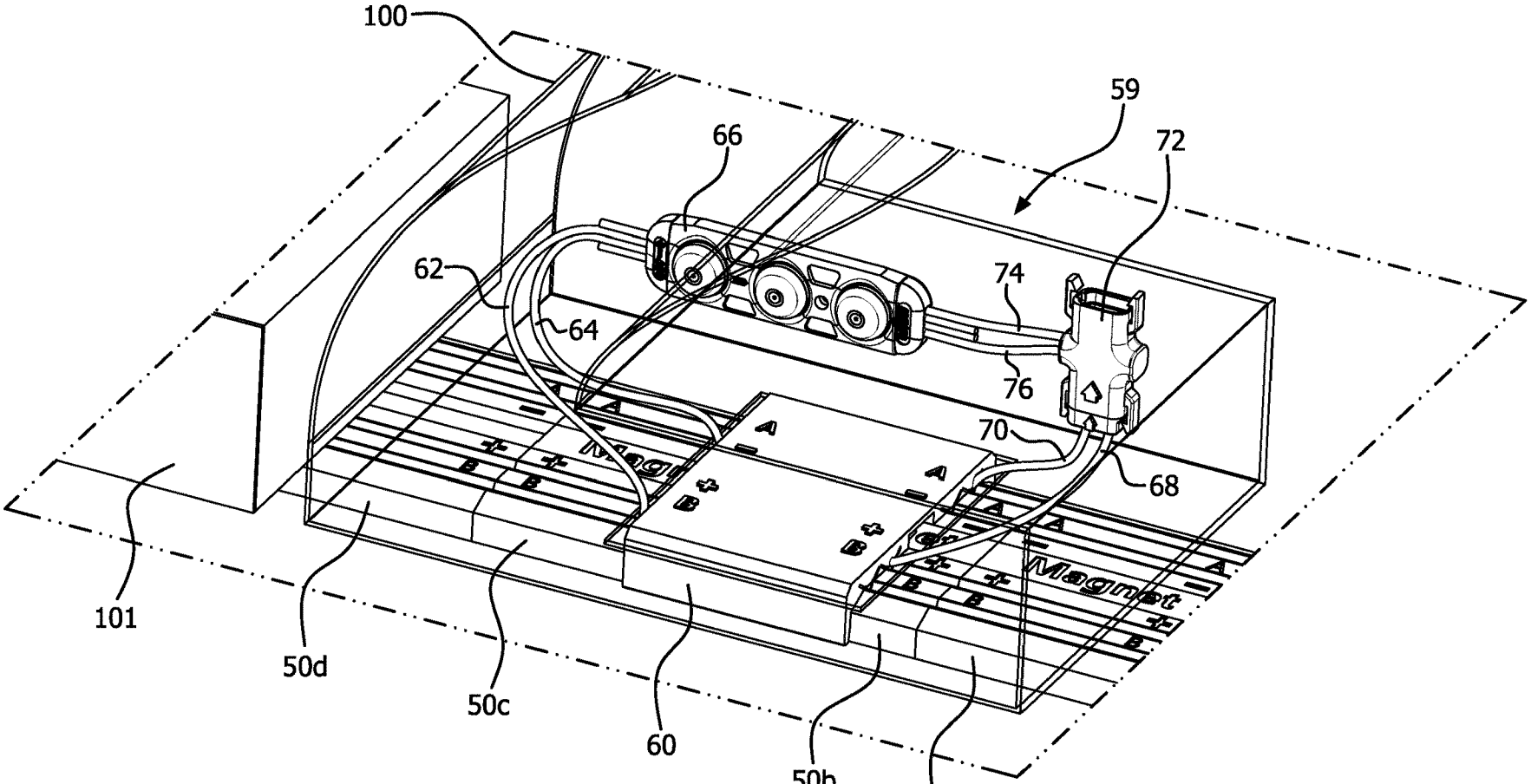
FIG. 5 is a close-up view of FIG. 3 showing the connection between the signage lighting member and the power source magnets used in the magnetic lighting system of the present invention.

FIGS. 3-5 illustrate a second magnetic lighting signage system 2 utilizing the unique concepts of the invention. Power source circuitry 38, best shown, in part, in FIG. 4, comprises electrical power source 40 providing electricity, via electrically wiring 42 to electrical power distribution splitter 44, which distributes electricity to a number of electric circuits via electrical connectors 45*a*-45*f*. Positive and negative electrical wiring 46 and 48 extend from power distribution splitter 44, via connector 45*a*, where the wiring is attached to power source magnet 50, to complete the electrical circuit from the power source to the magnet. Informational data wiring 47 and 49 extends from informational data controller 80 to power source magnet 50, which is also configured to accept informational data from the data controller. The power source magnet can comprise individual, adjacently aligned power source magnets, e.g. 50 and 50*a*-50*d*, as best seen in FIGS. 3-5, or a single, elongated power source magnet.

Lighting member circuitry 59 located internally of signage lighting member 100, comprises lighting member magnet 60, electrically connected by wiring 62 and 64 to LED module or similar light source 66. Informational data wiring 68 and 70 extends from lighting member magnet 60 to connector 72, which is connected to LED module 66 by wiring 74 and 76.

Figure 6:
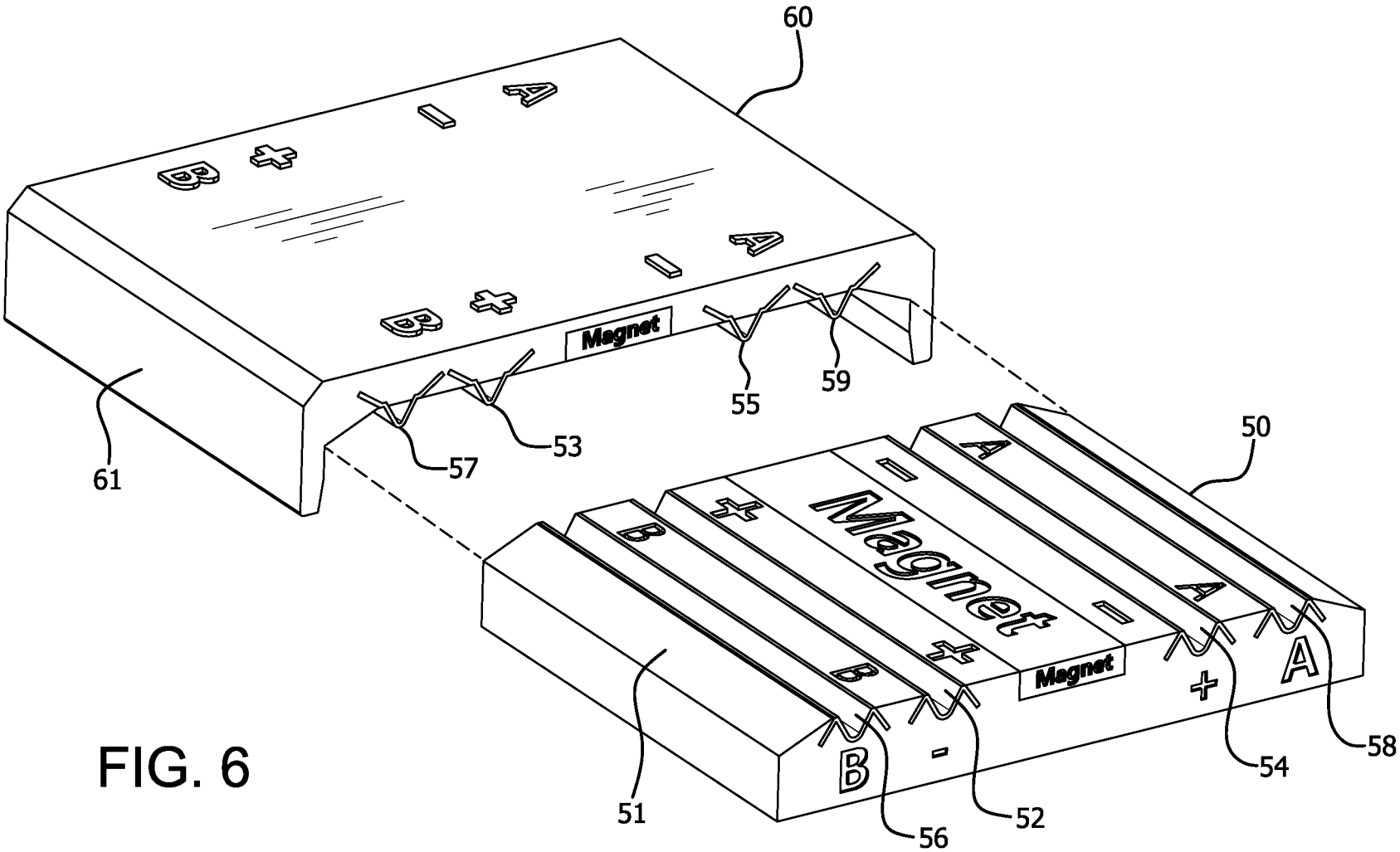
FIG. 6 is a perspective view of the power source magnet and lighting member magnet of the second embodiment of the magnetic lighting system of the present invention.
Figure 7:
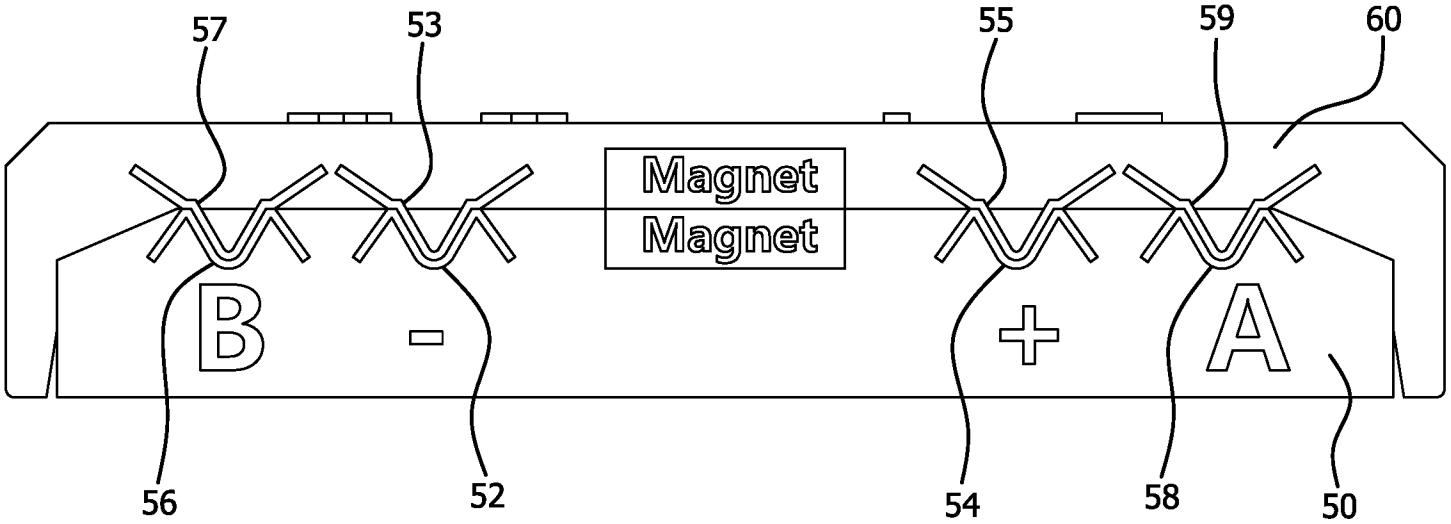
FIG. 7 is an end view of a power source magnet and a lighting member magnet of the second embodiment of the magnetic lighting system of the present invention with the magnets connected.

With specific reference to FIGS. 6 and 7, power source magnet 50 comprises integral body 51 and is configured to engage and mate with lighting member magnet 60. Power source magnet 50 (as well as magnets 50*a*-50*d* and the other power source magnets shown in FIG. 3) has electrical contact channels 52 and 54 which are configured to be electrically attached to wiring 46 and 48, in order to receive electricity via electrical connector 45*a*, power distribution splitter 44, and power source 40. Data contact receiving channels 56 and 58 are configured to be attached to data controller 80 via wiring 47 and 49.

Figure 8:
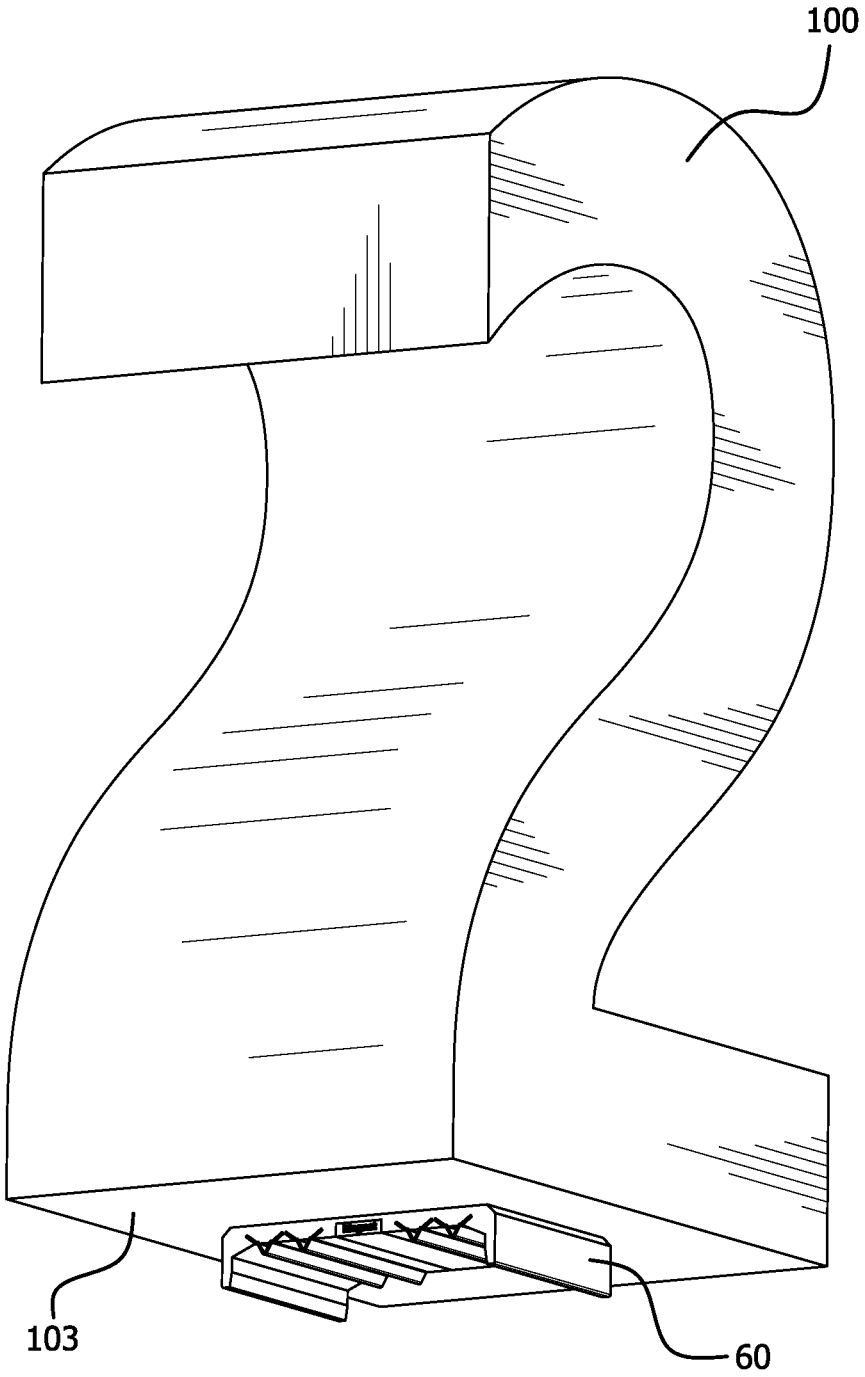
FIG. 8 is a perspective bottom view of a signage lighting member of the magnetic lighting system of the present invention illustrating the attachment between the lighting member and the lighting member magnet.

Lighting member magnet 60 comprises integral body 61 and has downwardly extending, elongated electrical contacts 53 and 55 which extend the length of the body. Contacts 53 and 55 are configured to be inserted into electrical contact channels 52 and 54. Downwardly extending informational data contacts 57 and 59 are configured to be inserted into data contact receiving channels 56 and 58. Lighting member magnet 60 is affixed to bottom surface 103 of signage lighting members 100 and 101, represented by the three dimensional "2s" shown in FIGS. 3 and 8.

When lighting member 100 with its light member magnet 60 affixed thereto is positioned atop power source magnet 50 such that data contacts 57 and 59 of light member 60 are inserted into data channels 56 and 58 and electrical contacts 53 and 55 are inserted into electrical contact channels 52 and 54, electricity and informational data are transmitted from power source 40 and controller 80, eventually to magnets 50 and 60 to illuminate light source 66 and signage lighting member 100 and to provide instructional data to connector 72 and the lighting member.

As previously described, individual signage LED (or equivalent) lighting members 100 and 101 each have a lighting member magnet affixed to their bottom surfaces. These lighting members are illuminated and are provided informational data simply by aligning their individual lighting member magnets with the power source magnets, so that they are attached to each other, electricity and informational data then being transmitted to lighting members 100 and 101 from power source 40 and controller 80, through the lighting member magnets 60, to illuminate the lighting members and provide them with informational data.

The magnetic lighting systems which are contemplated by the present invention are not to be considered restricted to the systems disclosed herein. Equivalent system modifications utilizing the concepts of the magnetic signage lighting and informational data systems of the present invention are within the scope of the invention. In addition, the systems disclosed herein should not be deemed to be restricted to both electrical signage lighting and informational data. It is contemplated that electrical signage lighting can be used independently of informational data transmission and vice versa. FIGS. 1 and 2 illustrate an example of the use of the present invention solely for illuminating electrical signage.

By the system of the present invention, signage and other types of lighting members can be quickly and easily replaced, without the need for the wire connection processes and the intense labor and monetary costs associated with these processes.

Certain novel features and components of this invention are disclosed in detail in order to make the invention clear in at least one form thereof. However, it is to be clearly understood that the invention as disclosed is not necessarily limited to the exact form and details as disclosed, since it is apparent that various modifications and changes may be made without departing from the spirit of the invention.

The invention claimed is:

1. A magnetic signage lighting system comprising:

electricity transferring wiring extending from an electrical power source to an electrical connector member;

at least one power source magnet electrically connected to said electrical connector member, said power source magnet comprising an integral body member having electrical contact channels inset from the top of and extending into and across the length of the body member;

a signage lighting member; and a lighting member magnet for providing electrical power to the signage lighting member, said lighting member magnet having an integral lighting member magnet body with electrical contacts extending downwardly from the side of the body and extending the length of the body, the electrical contacts being configured to be positioned over and inserted into the electrical contact channels such that the lighting member magnet is connected to and encompasses the power source magnet;

wherein when the electrical contacts of the lighting member magnet are inserted into the electrical contact channels of the power source magnet, electricity is transmitted from the electrical power source through the electrical connector member, to the power source magnet, and then to the lighting member magnet to illuminate the signage lighting member.

2. The magnetic signage lighting system as in claim 1 wherein the lighting member magnet is affixed to the signage lighting member.

3. The magnetic signage lighting system as in claim 1 further comprising a plurality of signage lighting members.

4. The magnetic signage lighting system as in claim 3 in which each of the plurality of signage lighting members has its own lighting member magnet.

5. The magnetic signage lighting system as in claim 4 further comprising a plurality of power source magnets, one of the plurality of power source magnets being electrically connected to one of the plurality of the signage lighting members.

6. The magnetic signage lighting system as in claim 1 wherein the signage lighting member comprises at least one LED module.

7. A magnetic signage lighting and informational data system comprising:

electricity transferring wiring extending from an electrical power source to an electrical connector member;

informational data transferring wiring extending from an informational data controller to a second electric connector member;

at least one power source magnet electrically connected to said electrical connector member and to the informational data controller, said power source magnet comprising an integral body member having electrical contact channels and informational data contact receiving channels, the electrical contact channels and the informational data contact receiving channels being inset from the top of and extending into and across the length of the body member;

a signage lighting member; and a lighting member magnet for providing electrical power and informational data to the signage lighting member, said lighting member magnet having an integral lighting member magnet body with electrical contacts and informational data contacts extending downwardly from the side of the body and extending the length of the body, the electrical contacts being configured to be positioned over and inserted into the electrical contact channels and the informational data contacts being configured to be positioned over and inserted into the informational data contact receiving channels such that the lighting member magnet is connected to and encompasses the power source magnet;

wherein when the electrical contacts and the informational data contacts of the lighting member magnet are inserted into the electrical contact channels and the informational data contact receiving channels of the power source magnet, electricity is transmitted from the electrical power source through the electrical connector member to the power source magnet and then to the lighting member magnet, and informational data is transmitted from the data controller to the power source magnet and then to the lighting member magnet, to illuminate and provide informational data to the signage lighting member.

8. The magnetic signage lighting and informational data system as in claim 7 wherein the lighting member magnet is affixed to the signage lighting member.

9. The magnetic signage lighting and informational data system as in claim 7 further comprising a plurality of signage lighting members, each lighting member having its own lighting member magnet.

10. The magnetic signage lighting and informational data system as in claim 9 further comprising a plurality of power source magnets, one of the plurality of power source magnets being electrically connected to one of a plurality of signage lighting members.

11. The magnetic signage lighting and data system as in claim 7 wherein a plurality of power source magnets are adjacently aligned with each other.

* * * * *